US005614878A

United States Patent [19]

Patrick et al.

[11] Patent Number: 5,614,878

[45] Date of Patent: Mar. 25, 1997

[54] TWO POLE REMOTE CONTROLLED CIRCUIT BREAKER

[75] Inventors: John R. Patrick, Tucker; Eduard Zubar, Duluth; Edward L. Tevis, Tucker, all of Ga.

[73] Assignee: Siemens Energy & Automation, Inc., Alpharetta, Ga.

[21] Appl. No.: 524,816

[22] Filed: Sep. 7, 1995

[51] Int. Cl.[6] ..... H01H 75/00

[52] U.S. Cl. ..... 335/14; 335/20

[58] Field of Search ..... 335/35, 14, 20

[56] References Cited

U.S. PATENT DOCUMENTS

| | | | |
|---|---|---|---|
| Re. 32,882 | 3/1989 | Yokoyama et al. | 335/14 |
| Re. 33,325 | 9/1990 | Yokoyama et al. | 335/14 |
| 4,164,719 | 8/1979 | Young et al. | 335/14 |
| 4,167,716 | 9/1979 | Horn | 335/14 |
| 4,178,572 | 12/1979 | Gaskill et al. | 335/14 |
| 4,223,288 | 9/1980 | Stiner | 335/20 |
| 4,292,612 | 9/1981 | Howell | 335/14 |
| 4,390,876 | 6/1983 | Bjorklund et al. . | |
| 4,456,832 | 6/1984 | Greer et al. . | |
| 4,479,101 | 10/1984 | Checinski | 335/37 |
| 4,529,951 | 7/1985 | Youichi et al. | 335/13 |
| 4,604,596 | 8/1986 | Yokoyama et al. | 335/14 |
| 4,623,859 | 11/1986 | Erickson et al. | 335/14 |
| 4,636,760 | 1/1987 | Lee | 335/14 |
| 4,716,392 | 12/1987 | Nakano et al. | 335/189 |
| 4,725,799 | 2/1988 | Bratkowski et al. | 335/14 |
| 4,879,535 | 11/1989 | Mori et al. | 335/14 |
| 4,901,219 | 2/1990 | Erickson et al. . | |
| 4,940,903 | 7/1990 | Brown, Jr. et al. | 307/122 |
| 4,964,058 | 10/1990 | Brown, Jr. | 364/492 |
| 4,965,694 | 10/1990 | Dvorak et al. | 361/64 |
| 5,003,139 | 3/1991 | Edds et al. | 200/401 |
| 5,028,853 | 7/1991 | Brown, Jr. et al. | 318/280 |
| 5,083,103 | 1/1992 | Winter et al. | 335/14 |
| 5,101,186 | 3/1992 | Durum . | |
| 5,180,051 | 1/1993 | Cook et al. . | |
| 5,493,264 | 2/1996 | Menier et al. | 335/14 |
| 5,519,367 | 5/1996 | Castonguay et al. | 335/20 |

OTHER PUBLICATIONS

Square D® Powerlink™ QO(B)–PL Remote Controlled Circuit Breaker Installation Instructions—Publication No. 84049602 Rev. May 1989 (2 pages).

Matsushita Electric Works, Ltd., HBRS Hyrid Breaker/Remote Switch—Publication Copyright Electric Power Research Institute May, 1990 (4 pages).

Eaton Cutler–Hammer Advertisement for Remote Controlled Breakers—not dated (1 page).

*Primary Examiner*—Lincoln Donovan

*Attorney, Agent, or Firm*—Ira Lee Zebrak

[57] ABSTRACT

A remote controlled circuit breaker providing thermal and magnetic overload current protection as well as remote load management capability.

4 Claims, 9 Drawing Sheets

TWO POLE REMOTE CONTROLLED CIRCUIT BREAKER

INTRODUCTION

1. Field of the Invention

The present invention relates generally to electric circuit breakers and more particularly to a remote controlled circuit breaker providing thermal and magnetic overload current protection as well as remote load management capability.

2. Background

In view of the increasing cost and difficulty of providing new or substitute electric power generating capacity, electric power companies have the capability of disconnecting and reconnecting their customers' loads in order to obviate the necessity for expanding their electric generating capacity to meet the peak or selected power demands which occur over short periods of time. Various devices have been provided which enable an electric power company to de-energize selected loads of certain customers without interrupting electric service to more critical loads.

Remote control circuit breakers are used by electric power companies for temporary interruption of electrical service, by opening and closing the circuit breakers on demand from a remote location during selected hours of operation when peak electrical demand typically occurs.

Some prior art remote controlled circuit breakers utilize a solenoid which is continuously energized to hold the circuit breaker in an open position. The energized solenoid, however can produce excessive amounts of heat. In an effort to limit the heat generated, other prior art remote controlled circuit breakers utilize motors instead of solenoids to open and close the contacts of the circuit breaker. However, since electric power companies generally use power line carried signals or directly broadcast signals to activate load shedding of selected loads during periods of peak power consumption, a malfunction in the signal transmitter can result in loss of power to those motors which had turned off the selected loads. Accordingly, those motors cannot restore power to those selected loads.

In other prior art remote controlled circuit breakers, destructive gasses, which are produced by the circuit breakers during short circuits, enter the region housing the remote control capabilities and contaminate the mechanical drive components and electrical components.

In some prior art remote controlled two pole circuit breakers, the breaker poles are not electrically isolated and the possibility of a phase to phase short circuit condition exists.

Operation of prior art remote controlled two pole circuit breaker devices necessitate the repeated operation of the actuator mechanism of the main circuit breaker pole components for load management control. Such repeated operations impart significant stress and fatigue which decrease the service life of the device. Although designs which provide a redundant set of contacts or a redundant set of components, one for load management control and another for overcurrent protection for each pole of the circuit breaker, can be employed to decrease the stress and fatigue on the circuit breaker pole components by precluding their operation during load management operation, such designs would be unduly complicated and unnecessarily expensive.

3. Objects of the Invention

It is therefore a general object of the present invention to provide an improved two pole remote controlled circuit breaker which overcomes the aforemention deficiencies of the prior art.

It is another objective of the present invention to provide a novel two pole remote controlled circuit breaker device for interrupting power to electric loads from a location remote from the load.

It is another object of the present invention to provide a two pole remote controlled circuit breaker which physically isolates the remote control capabilities from the circuit breaker poles to prevent destructive gasses produced by the circuit breakers during short circuits from entering the region housing the remote control capabilities and contaminating the mechanical and electrical components.

It is another object of the present invention to provide a remote controlled two pole circuit breaker which electrically isolates the breaker poles from one another to minimize the possibility of a phase to phase short condition from occurring.

It is another object of the present invention to provide a remote controlled two pole circuit breaker which eliminates the need to operate those components providing overcurrent protection thereby avoiding subjecting those components to the repeated cycles of stress from load management operations and thereby increasing the service life of the device.

It is another object of the present invention to provide a remote controlled two pole circuit breaker which upon loss of signal power will result in the closure of the circuit breaker contacts and a restoration of power to the load(s) .

It is another object of the present invention to provide a remote controlled circuit breaker which has reduced power consumption for maintaining the breaker contacts in the open position during load management cycles by using a continuous low energy signal to keep the breaker contacts in the open position.

SUMMARY OF THE INVENTION

In accordance with one aspect of the invention, a remote controlled circuit breaker is provided for overload current protection and load management for interrupting current flow in a circuit path between a source and a load, comprising: an electrically insulated housing having a circuit breaker compartment and a remote controlled actuator system compartment; a manually operable circuit breaker assembly having an opened tripped position and a closed position and arranged within the circuit breaker compartment; a remote controlled actuator system arranged within the remote controlled actuator system compartment; the manually operable circuit breaker assembly including: a stationary contact pad; a moveable contact pad for opening and closing against the stationary contact pad and cooperatively arranged in the circuit path and within the manually operable circuit breaker compartment so as to provide current flow from the source to the load; a moveable contact arm which is affixed to the moveable contact pad and which is moved to interrupt the current provided to the load; a manually operable spring powered mechanism connected to the moveable contact arm for opening and closing the moveable contact pad against the stationary contact pad; a tripping mechanism operatively connected to the manually operable spring powered mechanism to respond to a predetermined current overload condition by displacing the moveable contact pad from contact with the stationary contact pad to an opened tripped position of the circuit breaker; the remote controlled actuator system including: a remote controlled electromagnetically powered means having a pin which extends through a pin slot formed in said compartment housing the manually operable circuit breaker and into said compartment, said pin being disposed adjacent to the contact arm shield of the moveable contact arm for engaging and pulling the contact arm causing moveable contact pad to disengage from electrical contact with the stationary contact pad into an intermediate open position; and an electromagnetic solenoid means having a first energized state to mechanically actuate the remote controlled electromagnetically powered means for causing moveable contact pad to disengage from electrical contact with stationary contact pad; and further having a nonenergized state in which the pin is caused to be returned to a disengaged position form the contact arm shield in response to a biasing spring means.

DETAILED DESCRIPTION OF THE PREFERRED EMBODIMENT

Figure 1:
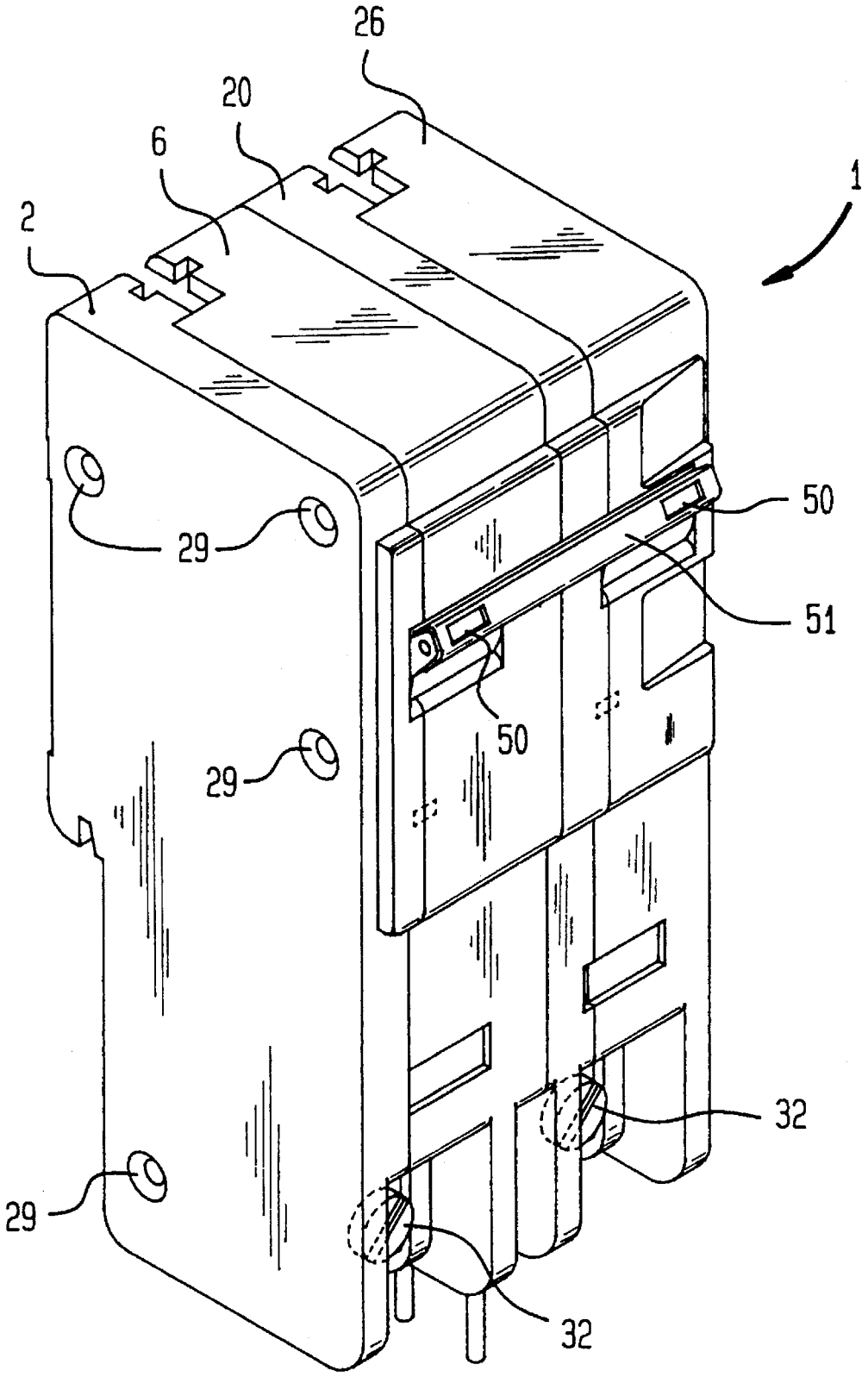
FIG. 1 is a perspective view looking down on the Two Pole Remote Controlled Circuit Breaker Assembly constructed in accordance with the teachings of the present invention.
Figure 2:
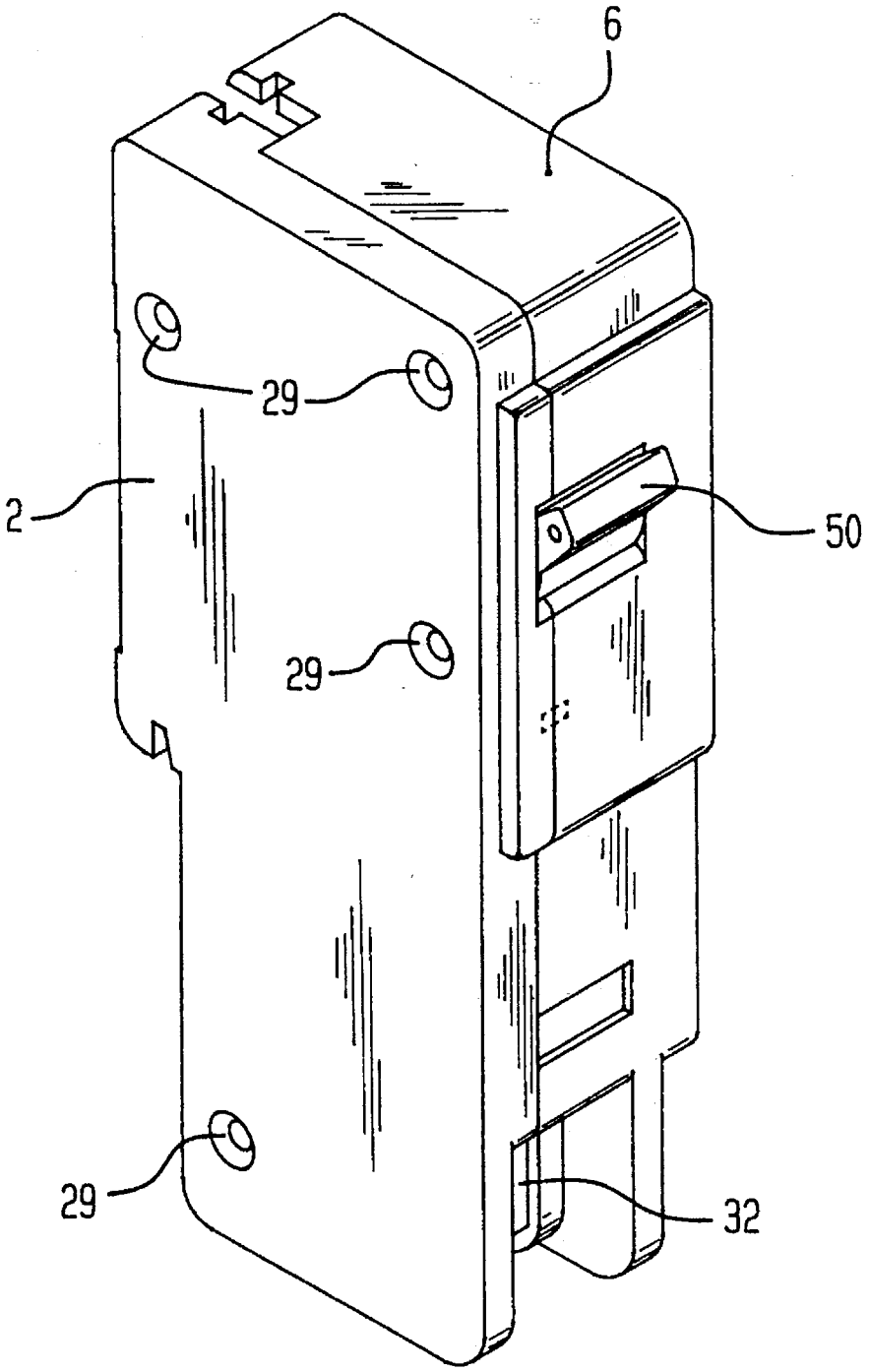
FIG. 2 is an enlarged perspective view of a portion of FIG. 1 showing the left pole circuit breaker housing.

The Two Pole Remote Controlled Circuit Breaker of the present invention is comprised of a left pole circuit breaker assembly, a right pole circuit breaker assembly, and a remote controlled actuator system which simultaneously opens or closes the contacts of each of the left circuit breaker and right circuit breaker to remotely switch loads off and on. Referring to FIG. 1, the Two Pole Remote Controlled Circuit Breaker 1 of the present invention is shown. Two Pole Remote Controlled Circuit Breaker 1 is enclosed within a molded housing formed of an electrically insulative material. The portion of the housing formed by a left pole base 6 and by a left pole cover 2, shown in more detail in FIG. 2, contains a left pole circuit breaker 30L (shown in FIG. 3), which circuit breaker is positioned and enclosed within an interior compartment of the housing. Similarly, the portion of the housing formed by right pole base 26 and by a right pole cover 20, shown in more detail in FIG. 4, contains the right pole circuit breaker 30R (shown in FIG. 5), which circuit breaker is positioned and enclosed within an interior compartment of the housing. Right pole base 26, right pole cover 20, left pole base 6 and left pole cover 2 are secured together by transversely extending rivets 29. The housing for the Two Pole Remote Controlled Circuit Breaker assembly is of the size and shape of a conventional two pole circuit breaker and is readily mountable in a residential or commercial electric distribution panel at locations designated for conventional circuit breakers.

Figure 6:
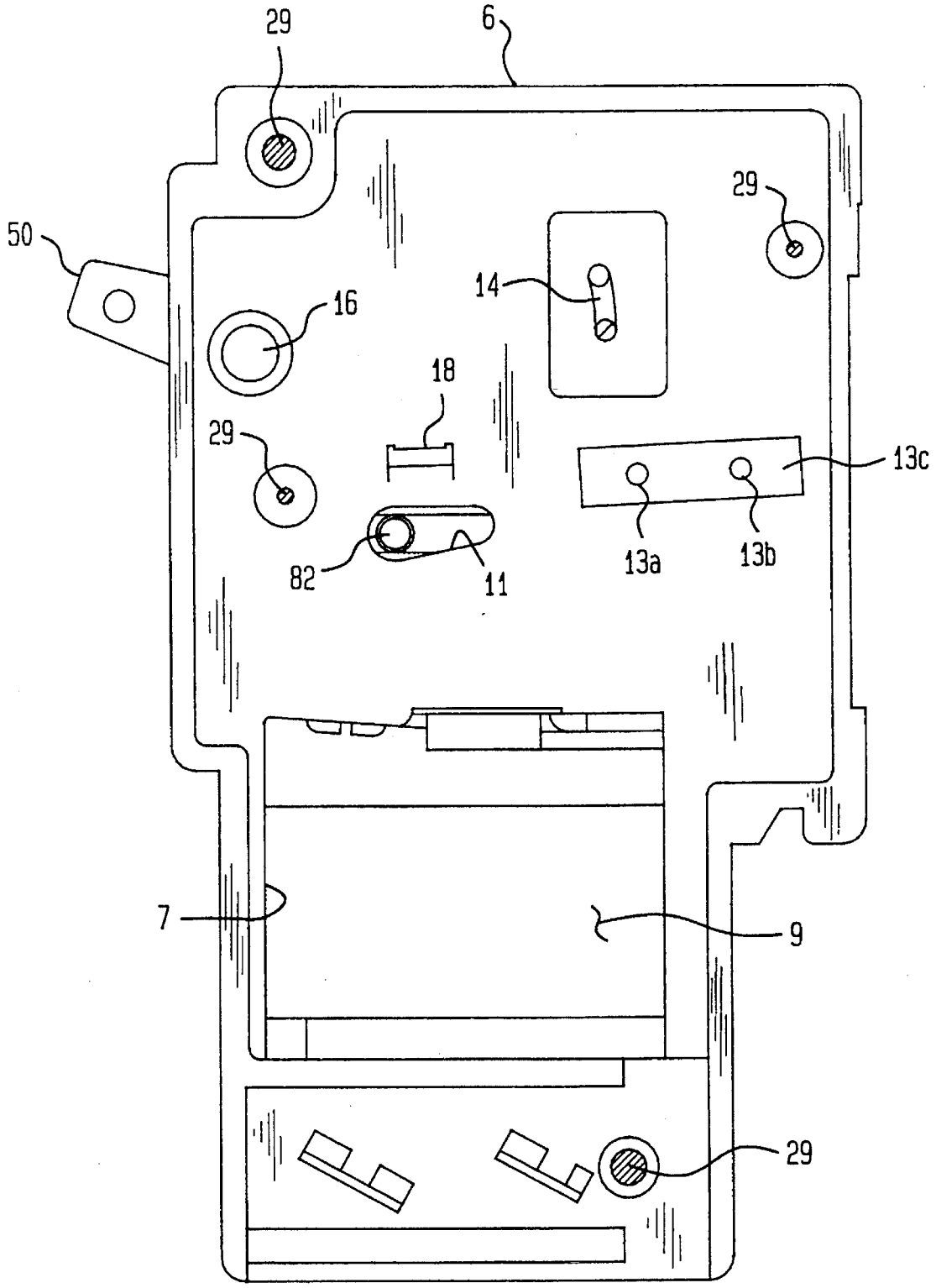
FIG. 6 is a side view of the opposite side of the left pole circuit breaker assembly housing shown in FIG. 3 illustrating an inside wall of the center section which houses the components for remote control of the circuit breaker poles.

The remote controlled actuator system is positioned within a center interior compartment of the housing comprised of the interior region between the left pole base 6 and right pole cover 20. Right pole cover 20 separates the right pole circuit breaker 30R from the remote controlled actuator system positioned in the center compartment (FIGS. 1 and 4) and the left pole base 6 similarly separates the left pole circuit breaker 30L from the remote controlled actuator system positioned in the center compartment (FIGS. 1 and 6). Right pole base 26 mates with right pole cover 20 which mates with left pole base 6 which in turn mates with left pole cover 2 so that the center compartment which contains the remote controlled actuator system is isolated from each of the breaker poles. This isolation prevents the destructive gasses which can be produced during operation from entering and contaminating the remote controlled actuator system. The center compartment also electrically isolates the left circuit breaker assembly from the right circuit breaker assembly which minimizes the possibility of a phase to phase dielectric breakdown.

Figure 3:
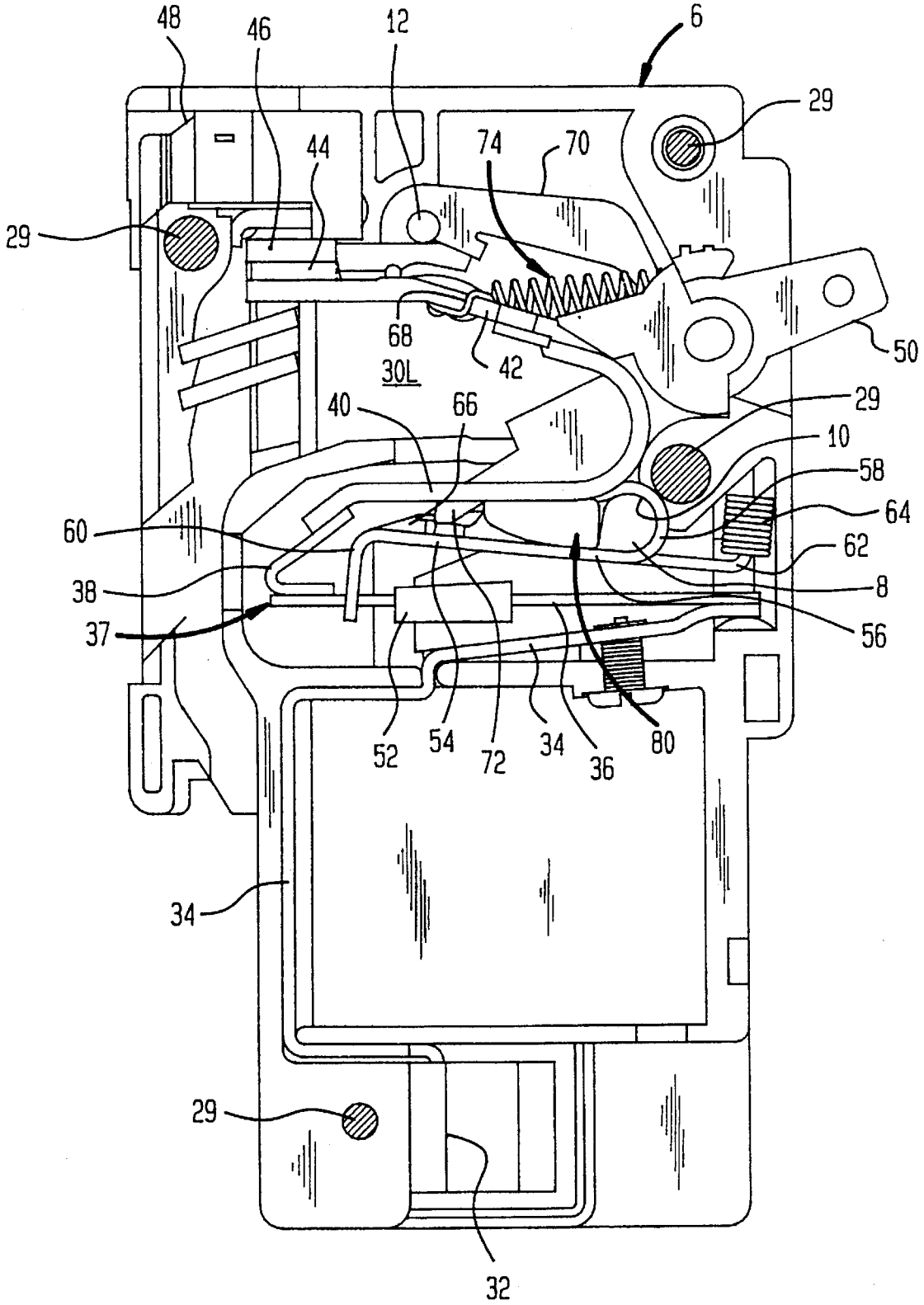
FIG. 3 is a side view of the left pole circuit breaker in FIG. 2 with its outer cover removed showing the left pole circuit breaker.
Figure 5:
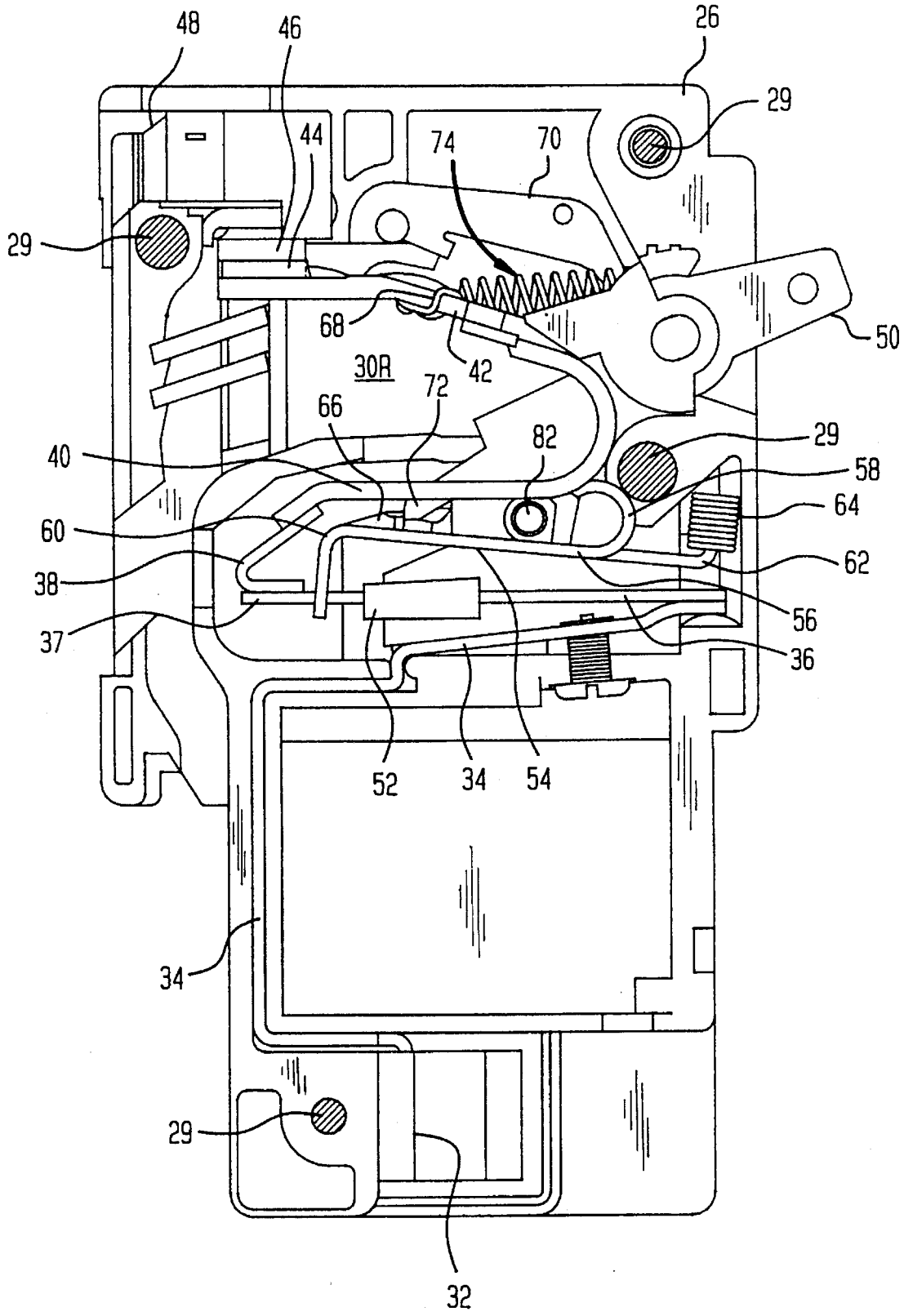
FIG. 5 is a side view of the right pole circuit breaker in FIG. 4 with its outer cover removed showing the right pole circuit breaker assembly.

The right pole circuit breaker 30R and the left pole circuit breaker 30L are of identical construction and reference in the following description to the left pole circuit breaker and its operation is illustrative of both the left pole circuit breaker as well as the right pole circuit breaker. Left pole circuit breaker 30L is shown in FIG. 3, positioned with left pole base 6 and with the left pole cover 2 removed. Right pole circuit breaker 30R is shown in FIG. 5 using the same reference numerals to refer to the corresponding elements of the left pole circuit breaker shown in FIG. 3. Each of the right and left circuit breakers 30R and 30L are of the type shown and described in U.S. Pat. No. 4,479,101 which is hereby incorporated by reference.

Figure 10:
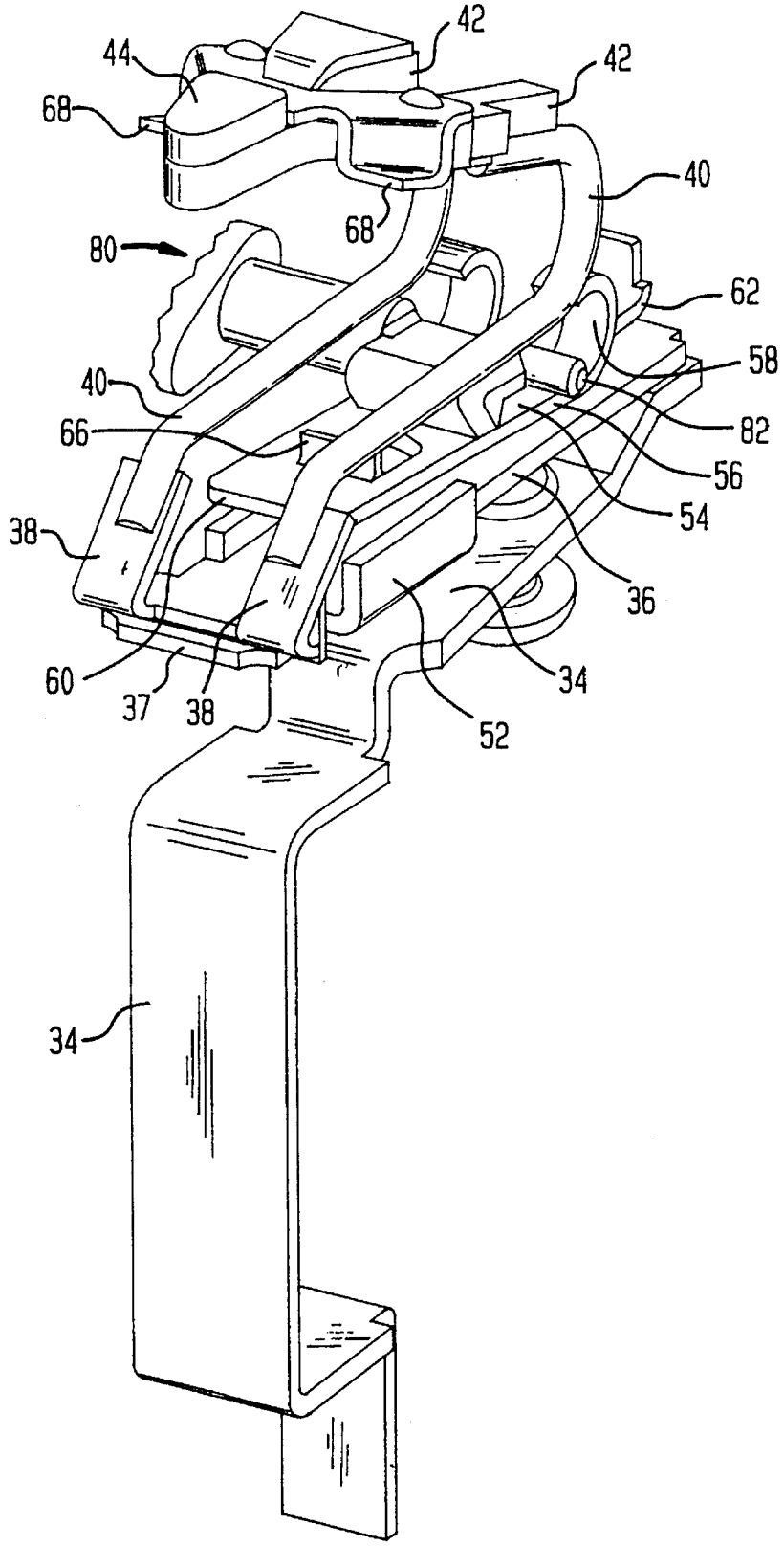
FIG. 10 is a perspective view of the main current path through the left pole circuit breaker from the conducting strap to the moveable contact pad.

Referring to FIGS. 3 and 10, the current-carrying path within the left pole circuit breaker assembly 30L is via a terminal 32 which is in electrical contact with conducting strap 34 which is, in turn, in electrical contact with bimetallic strip 36. Two V-shaped straps 38 contact free end 37 of bimetallic strip 36 and each strap 38 is connected to a contact arm braid 40. Each contact arm braid 40 is in turn connected to a moveable contact arm 42 secured to which is a contact pad 44. Contact pad 44 of moveable contact arm 42 makes electrical contact with stationary pad 46 (FIG. 3) which is in turn connected to a line terminal assembly 48. An operating handle 50 is provided for manually operating the circuit breaker to disrupt electric current flow between the moveable contact pad 44 and stationary contact pad 46. A cap 51 mechanically connects operating handles 50 of the right circuit breaker and left circuit breaker together. Contact arm shields 68 which are secured to each moveable contact arm 42 deflects the arc blast during short circuit interruptions and prevents annealing of coiled spring 74.

The left pole circuit breaker assembly has a magnetic trip mechanism which is operative in response to a sudden current overload condition to open the contacts of the circuit breaker. The magnetic trip mechanism uses a magnetic field generated by an electromagnet to attract and move an armature which movement releases a latch of a manually operable spring powered mechanism which enables the opening of the contacts of the circuit breaker as more fully described below. Referring to FIGS. 3 and 10, bimetallic strip 36 has an electromagnet 52 which is in the form of a yoke partially surrounding three sides of bimetallic strip 36. Electromagnet 52 is in a fixed position in the current path while a moveable magnetically conductive armature 54 is disposed in moveable juxtaposition with respect to electromagnet 52. Armature 54 has a first end 56 with a curved arm portion 58 and a second end opposite the first having an L shaped portion 60. Curved arm portion 58 of armature 54 is positioned on a pivot surface 10 of pivot guide 8 and armature 54 is thereby disposed in moveable juxtaposition with electromagnet 52. First end 56 has an extension 62 to receive an armature spring 64 which produces a biasing force to maintain the second end 60 of armature 54 away from electromagnet 52 and bimetallic strip 36 under non-overload or normal operating conditions. When current through the current path of the left pole circuit breaker 30L exceeds a predetermined amount, electromagnet 52 produces a magnetic field which causes the second end 60 of armature 54 to be attracted and move toward electromagnet 52 to overcome the biasing force of compression of armature spring 64 and cause armature 54 to pivot about pivot guide 8. Armature 54 has a latch holder 66 against which a latch 72 is maintained so that when armature 54 is caused to move in response to electromagnet 52, latch holder 66 moves to release latch 72 which, as described below, causes movable contact 44 to move and electrically disconnect from stationary contact 46.

The manually operable spring powered mechanism for operating moveable contact 44 includes a cradle 70 which is pivotally mounted at one end on pivot guide 12. The other end of cradle 70 remote from pivot guide 12 is the latch 72 referred to above and which engages latch holder 66 on armature 54. Operating spring 74 extends between the circuit breaker contact arms 42 and cradle 70. When electromagnet 52 pulls armature 54 toward it, latch holder 66 moves from engagement with latching lip 72 of cradle 70 which rotates around pivot guide 12 in a clockwise direction (FIG. 3). Operating spring 74 which is connected at one end to cradle 70 and at its other end to contact arms 42 thereby pulls contact arms 42 in a counterclockwise direction and displaces moveable contact pad 44 from electrical contact with stationary contact pad 46 to trip the circuit.

The left pole circuit breaker assembly 30L also has a thermal trip mechanism which is operative in response to overload current of a duration which causes a bimetallic strip to heat and deflect permitting a latch to be released and thereby opening a set of contacts. Referring once again to FIGS. 3 and 10, bimetallic strip 36 has a free end 37 which is in electrical contact with V-shaped straps 38 each of which is connected to a contact arm braid 40. Armature 54 has an L-shaped second end 60 which has a hook for engaging bimetallic strip 36. When an overload current condition occurs, bimetallic strip 36 will heat which will cause its free end 37 to deflect away from armature 54. As free end 37 of bimetallic strip 36 deflects away from armature 54, it engages the hook in armature 54 and pulls armature 54 with it causing armature 54 to pivot about pivot guide 8 and overcome the biasing force of armature spring 64. As armature 54 pivots about pivot guide 8, latch holder 66 which is affixed to armature 54 moves and disengages latching lip 72 of cradle 70. Cradle 70 in turn is free to rotate around pivot guide 12 in a clockwise direction due to the force of operating spring 74 which also pulls contact arms 42 to disengage contact pad 44 from stationary contact pad 46 thereby opening and tripping the circuit breaker.

If either one of the left pole circuit breaker 30L or right pole circuit breaker 30R is tripped but not the other, a common trip lever 80 (FIG. 3) trips the second circuit breaker. Cross bar 82 (FIG. 10) of common trip lever 80 extends transversely from one circuit breaker to the other. Crossbar 82 extends in one direction through aperture 22 formed in right pole cover 20 (FIG. 4) where it is secured to armature 54 of the right pole circuit breaker 30R. Crossbar 82 also extends in the opposite direction through aperture 11 formed in left pole base 6 (FIG. 6) where it is similarly secured to armature 54 of the left pole circuit breaker 30L. If the armature of one pole is caused to be moved in response to an over current condition, then cross bar 82 of common trip lever 80 causes the armature of the other pole to move in the same way thereby tripping both the left circuit breaker and right circuit breaker together.

Referring to FIG. 5, right pole circuit breaker 30R is positioned and enclosed within an interior compartment of the housing formed by a right pole base 26 and a right pole cover 20 (FIG. 1). As stated above, right pole circuit breaker 30R is identically constructed and operates as left pole circuit breaker 30L shown in FIG. 3 and accordingly need not be described.

Figure 4:
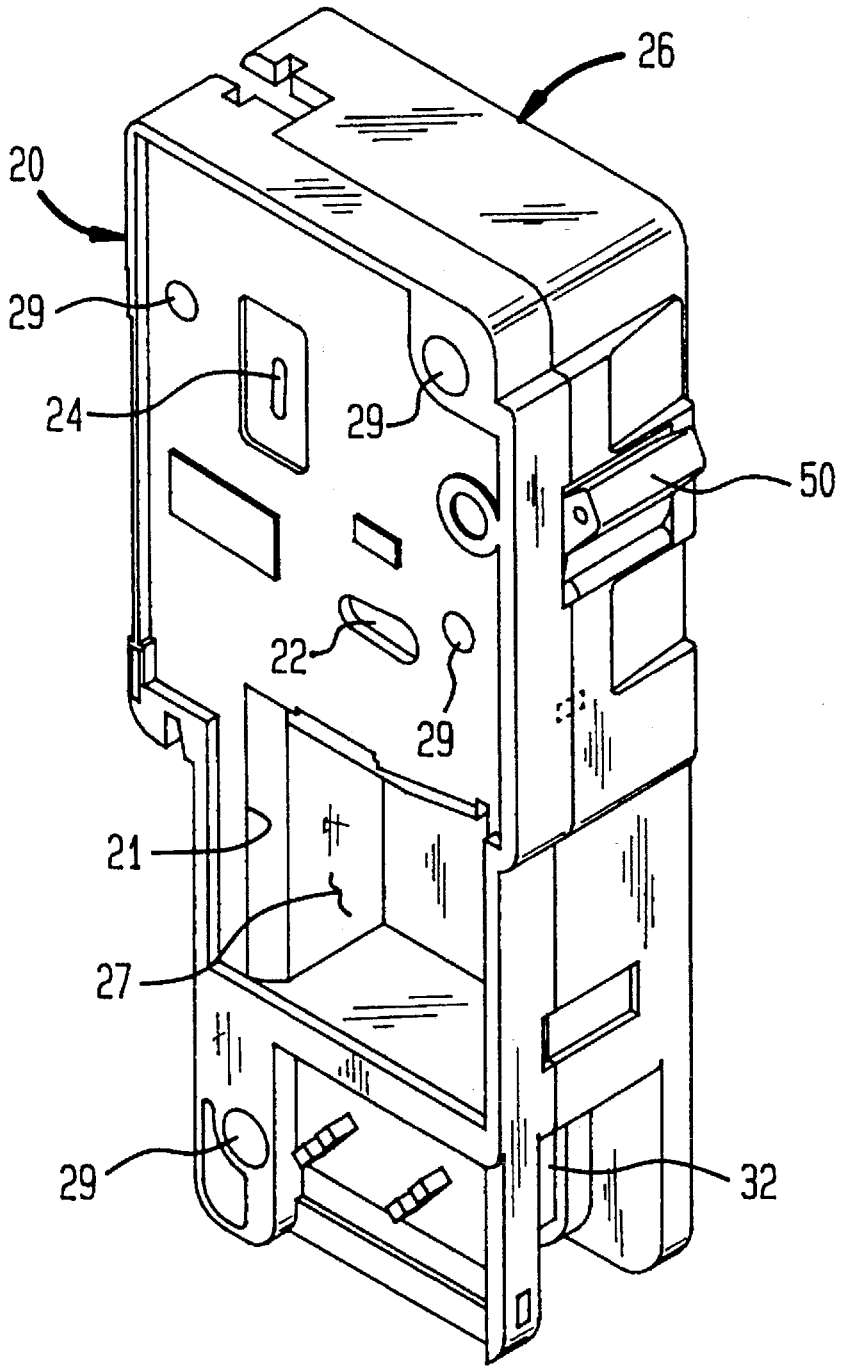
FIG. 4 is an enlarged perspective view of a portion of FIG. 1 with the left circuit breaker housing removed and showing the right pole circuit breaker housing.
Figure 7:
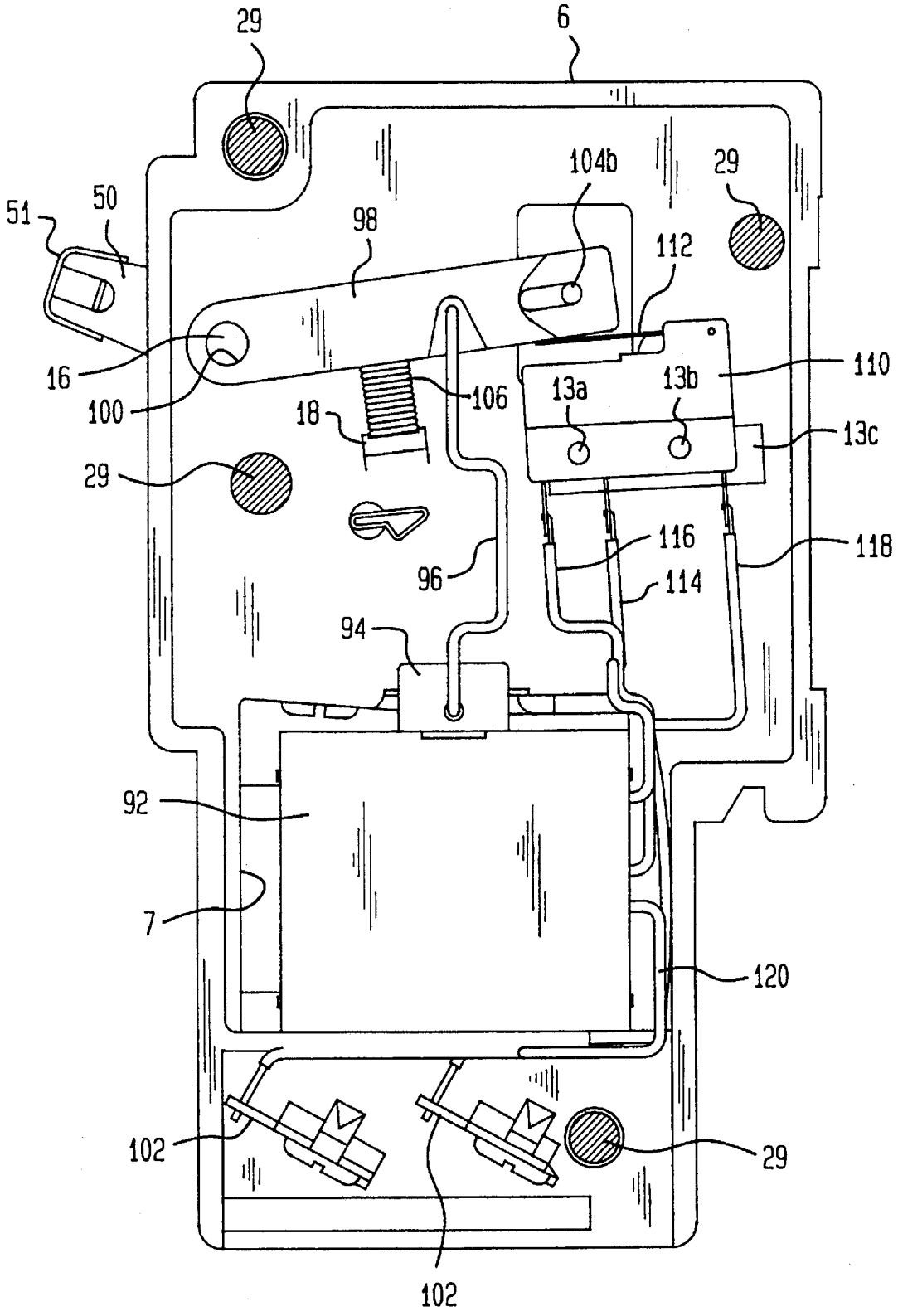
FIG. 7 is the same view as FIG. 6 but further showing the components of the remote controlled actuator system for remote control of the circuit breaker poles.
Figure 9:
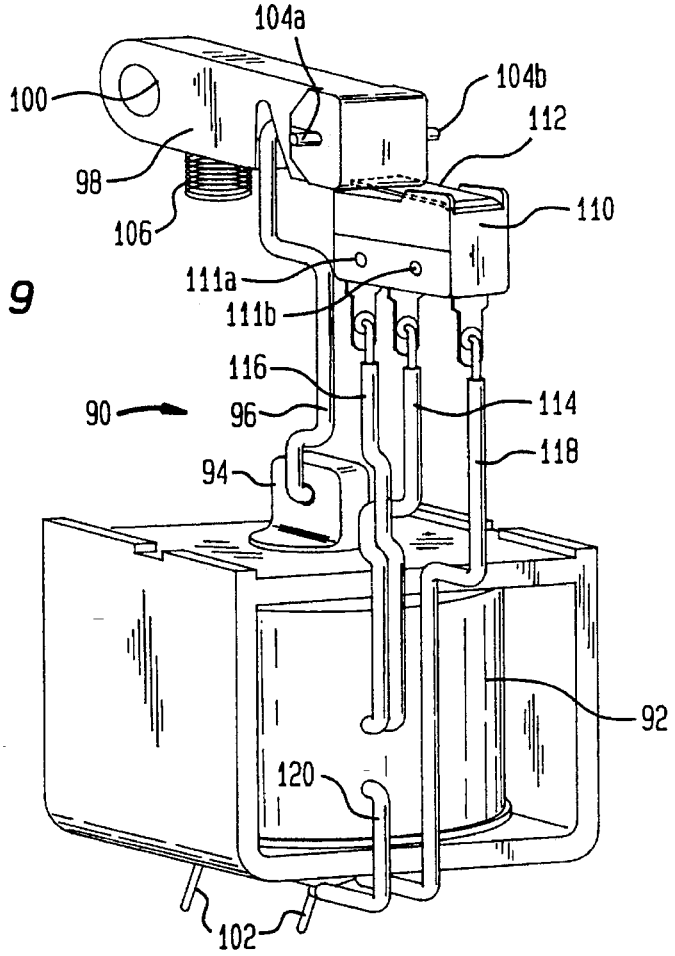
FIG. 9 is a perspective view of the remote controlled actuator system shown in FIG. 7.

Referring to FIGS. 7 and 9, the remote controlled actuator system 90 includes an electromagnetic solenoid 92 which enables the remote opening or closing of the circuit breaker contacts 44 and 46 of the left and right pole circuit breakers. In order to accommodate various sized solenoids which may be selected as a matter of design choice but without the necessity of increasing the overall width of the Two Pole Remote Controlled Circuit Breaker beyond the dimensions of conventional double pole circuit breakers, a chamber may be formed in each of the left pole circuit breaker assembly and right pole circuit breaker assembly to accommodate the span of the solenoid. Referring to FIG. 4, right pole cover 20 is adapted to have an opening 21 which extends therethrough to right pole base 26 which forms chamber 27 to accommodate solenoid 92. Referring to FIG. 6, left pole base 6 is adapted to have an opening 7 which extends therethrough to left pole cover 2 which forms chamber 9 to accommodate solenoid 92.

Figure 8:
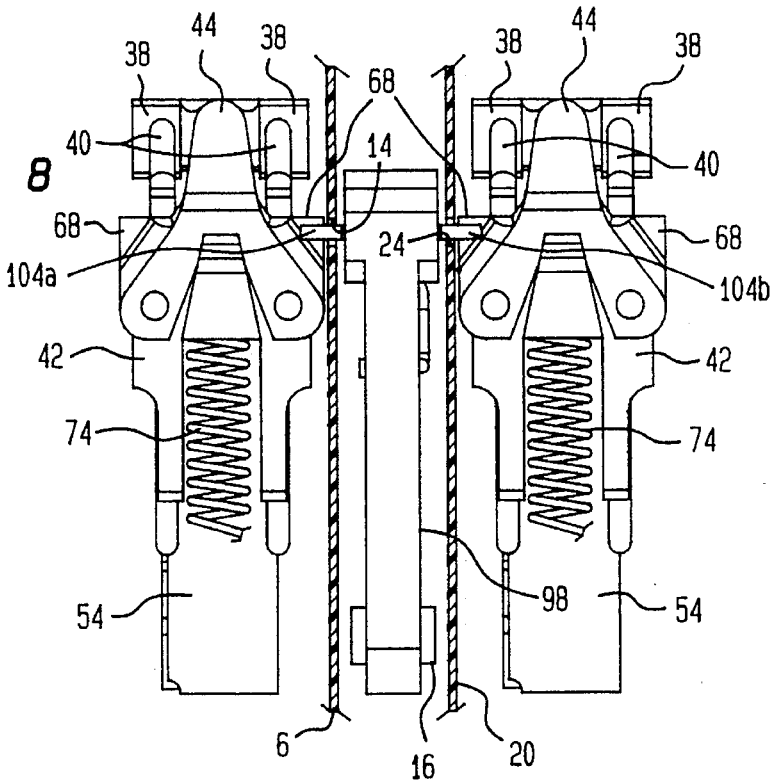
FIG. 8 is a top view of the portion of the Two Pole Remote Controlled Circuit Breaker Assembly shown in FIG. 1 with the outer and upper walls removed and showing the position of the pins of the remote controlled actuator system which engage the contact arm shields of the left and right circuit breakers for remote control opening.

Electromagnetic solenoid 92 responds to a control signal by providing the energy to the following described configuration of mechanical components which enables the opening of the circuit breaker contacts 44 and 46 permitting remote control of electric load switching. Positioned within solenoid 92 is a plunger 94 which is mechanically connected at one end to linkage lever 96. Linkage lever 96 is connected at its other end to a crank 98 which is adapted to have an opening 100 at one end for mounting upon a crank pivot 16 formed in the wall of left pole base 6. Crank 98 is biased in an upward position by crank spring 106 which is mounted on platform 18 formed in the wall of left pole base 6. At the end of crank 98 opposite pivot 16 are two pins **104*a* and 104*b*. Pin 104*a* projects orthogonally from one side wall of crank 98, and pin 104*b* projects orthogonally from the other sidewall. Pin 104*a* extends through a pin slot 14 in left pole base 6 and into the compartment which houses the left pole circuit breaker. (See FIG. 6). Pin 104*b* extends through a pin slot 24 in right pole cover 20 and into the compartment which houses the right pole circuit breaker. (See FIG. 4). Pin slots 14 and 24 are positioned in left pole base 6 and in right pole cover 20, respectively, so that the free ends of pins 104***a* and 104*b* align respectively with an upper surface of contact arm shield 68 of the right circuit breaker assembly 30R and an upper surface of contact arm shield 68 of left circuit breaker assembly 30L as shown in FIG. 8.

When a direct current signal is applied to terminals 102 of solenoid 92, a magnetic force is created which pulls plunger 94 in an axial direction downward from an extended at rest position to a retracted position into solenoid 92. The movement of plunger 94 into solenoid 92 pulls linkage lever 96 downward which causes a clockwise rotation of crank 98 around pivot 16. When the movement of the plunger 94 into solenoid 92 pulls linkage lever 96 downward causing a clockwise rotation of crank 98 around pivot 16, pins 104*a* and 104*b* engage contact arm shield 68 of left circuit breaker 30L and contact arm shield 68 of right circuit breaker 30R, respectively. This pulls the contact arm 42 of right pole circuit breaker 30R and the contact arm 42 of left pole circuit breaker 30L downward to cause moveable contact pad 44 of the right pole circuit breaker 30R and moveable contact pad 44 of left pole circuit breaker 30L to move a distance away from stationary contact 46 in each of the left and right circuit breakers to an open intermediate position. The distance that the moveable contact 44 is moved from contact with stationary contact 46 by remote controlled actuator system 90 to the open intermediate position is sufficient to separate the contacts for normal load switching but is limited so as not to open or trip the circuit breaker mechanism to either an open position or an open tripped position of either the left pole circuit breaker or the right pole circuit breaker. The distance that the moveable contacts are pulled open for normal load switching and without actuating the circuit breaker mechanism is as little as approximately 0.062 inch. By limiting the distance that the contacts are opened, actuation of the circuit breaker mechanism for normal load switching is eliminated.

Actuation of the circuit breaker mechanism for normal load switching results in unnecessarily subjecting the circuit breaker mechanism to stress and fatigue leading to early or premature withdrawal from service. Since limiting fatigue factors on the circuit breaker mechanism are the stresses on the contact arm braids and the coiled springs due to the "snapping" action of the contacts to open and closed positions and the stresses on the contact pads due to the high velocity impact on closing the contacts, the present invention offers significant advantages over the prior art in avoiding the necessity to actuate the circuit breaker mechanism during normal load switching and results in a substantial increase in the service life of the device.

When the applied signal to solenoid 92 is removed or interrupted, the solenoid loses its energy source and pins 104*a* and 104*b* release contact arm shields 68 allowing coiled spring 74 to pull contact arms 42 in a clockwise direction causing moveable contact pads 44 to close onto stationary contacts 46. Crank spring 106 is then released to cause crank 98 to rotate in a counter-clockwise direction which thereby moves pins 104*a* and 104*b* upward into a stored position and pulls linkage lever 96 upward which in turn pulls plunger 94 upward and into its extended and rest position. When pins 104*a* and 104*b* are in their stored position, they are no longer in contact with contact arm shields 68 and electrical isolation between left circuit breaker assembly and the right circuit breaker assembly is enhanced.

In an alternative embodiment of the present invention, in order to reduce power consumption of the solenoid which requires a continuous signal to keep the breaker contacts in an open position and to eliminate the possibility of overheating of the solenoid, the solenoid is provided with two coil windings. The first coil winding is a low resistance high current (approximately 3 amp) winding which produces a strong magnetic force to pull plunger 94 from its rest (extended) position to its activated (retracted) position where the plunger is withdrawn into the body of the solenoid. The second coil winding is a high resistance winding which, when connected in series with the low resistance winding, results in reduced power consumption for maintaining contacts 44 in an open position. The switching from the low resistance high current winding to the high resistance winding connected in series with the low resistance winding is accomplished by a solenoid switch 110 which is activated/deactivated by a switch lever 112. (See FIGS. 7 and 9).

Referring to FIGS. 7 and 9, solenoid switch 110 is mounted to left pole base 6 by mounting pins 13*a*, 13*b* which extend from base 6 and which pass through mounting holes 111*a* and 111*b* in switch 110 to secure it in position. A switch lever 112 extends from solenoid switch 110 and is positioned below the free end of crank 98 so that when crank 98 is pulled downward by linkage lever 96, it is caused to rotate in a clockwise direction around pivot 16. The downward travel of the free end of crank 98 depresses switch lever 112 of solenoid switch 110 as well as causing pins 104*a* and 104*b* to engage and pull the contact arm shields 68 of the right and left pole circuit breakers to open the circuit breaker contact pads. When lever 112 is depressed, the high resistance winding of solenoid 92 is connected in series with the low resistance winding, and the solenoid current draw is reduced to approximately 0.144 amps which permits continuous operation of the solenoid without overheating and with reduced power consumption.

While the foregoing description and drawings represent the preferred embodiments of the present invention, it will be apparent to those skilled in the art that various changes and modifications may be made therein without departing from the true spirit and scope of the present invention.

In the claims:

1. A remote controlled circuit breaker providing overload current protection and load management for interrupting current flow in a circuit path between a source and a load, comprising:

an electrically insulated housing having a circuit breaker compartment and a remote controlled actuator system compartment;

a manually operable circuit breaker assembly having an opened position and an opened tripped position and a closed position and arranged within the circuit breaker compartment;

a remote controlled actuator system arranged within the remote controlled actuator system compartment;

the manually operable circuit breaker assembly including:

a stationary contact pad;

a moveable contact pad for opening and closing against the stationary contact pad and cooperatively arranged in the circuit path and within the manually operable circuit breaker compartment so as to provide current flow from the source to the load;

a moveable contact arm which is affixed to the moveable contact pad and which is moved to interrupt the current provided to the load;

a manually operable spring powered mechanism connected to the moveable contact arm for opening and closing the moveable contact pad against the stationary contact pad;

a tripping mechanism operatively connected to the manually operable spring powered mechanism to respond to a predetermined current overload condition by displacing the moveable contact pad from contact with the stationary contact pad to an opened tripped position of the circuit breaker;

the remote controlled actuator system including:

a remote controlled electromagnetically powered means having a pin which extends through a pin slot formed in said compartment housing the manually operable circuit breaker and into said compartment, said pin being disposed adjacent to the contact arm shield of the moveable contact arm for engaging and pulling the contact arm causing moveable contact pad to disengage from electrical contact with the stationary contact pad into an intermediate open position; and an electromagnetic solenoid means having a first energized state to mechanically actuate the remote controlled electromagnetically powered means for causing moveable contact pad to disengage from electrical contact with stationary contact pad; and further having a non-energized state in which the pin is caused to be returned to a disengaged position form the contact arm shield in response to a biasing spring means.

2. The remote controlled circuit breaker as in claim 1 wherein the manually operable circuit breaker assembly is two manually operable circuit breaker assemblies, a first manually operable circuit breaker assembly arranged in a left circuit breaker compartment and a second manually operable circuit breaker assembly arranged in a right circuit breaker compartment.

3. The remote control circuit breaker in claim 2 wherein the remote controlled actuator system compartment is disposed between the left circuit breaker compartment and the right circuit breaker compartment.

4. The remote control circuit breaker as in claim 3 wherein the remote controlled powered means includes a first pin and a second pin, the first pin extending through a pin slot formed in the left circuit breaker compartment, said first pin being disposed adjacent to the contact arm shield of the moveable contact arm of the first circuit breaker assembly for engaging and pulling said contact arm into an intermediate position causing moveable contact pad to disengage from electrical contact with the stationary contact pad of the first circuit breaker assembly, said second pin extending through a pin slot formed in the right circuit breaker compartment, said second pin being disposed adjacent to the contact arm shield of the moveable contact arm of the second circuit breaker assembly for engaging and pulling said contact arm into an intermediate position causing moveable contact pad to disengage from electrical contact with the stationary contact pad of the second circuit breaker assembly.

* * * * *